United States Patent [19]

Kume et al.

[11] 4,092,820

[45] June 6, 1978

[54] ELECTRONIC TIMEPIECE

[75] Inventors: Kazunari Kume; Minoru Watanabe, both of Tokorozawa; Hideshi Oono, Sayama; Munetaka Tamaru, Tokyo, all of Japan

[73] Assignee: Citizen Watch Company Limited, Tokyo, Japan

[21] Appl. No.: 661,577

[22] Filed: Feb. 26, 1976

[30] Foreign Application Priority Data

Mar. 25, 1975 Japan ..... 50-035795
May 30, 1975 Japan ..... 50-064172

[51] Int. Cl.[2] ..... G04B 27/08; G04C 3/00; G04C 9/00

[52] U.S. Cl. ..... 58/23 R; 58/23 D; 58/34; 58/85.5; 58/88 R; 58/90 R; 58/125 R; 58/126 R

[58] Field of Search ..... 58/23 R, 23 BA, 23 D, 58/34, 53, 55, 85.5, 88 R, 125 R, 90 R, 126 R, 127 R; 340/365 A

[56] References Cited

U.S. PATENT DOCUMENTS

| | | | |
|---|---|---|---|
| 2,800,799 | 7/1957 | Contant | 58/23 D X |
| 3,584,162 | 6/1971 | Krakinowski | 340/365 A X |
| 3,784,725 | 1/1974 | Perkins et al. | 58/23 R X |
| 3,792,577 | 2/1974 | Fujita | 58/23 R |
| 3,852,951 | 12/1974 | Sauthier | 58/23 R |
| 3,857,235 | 12/1974 | Wolber | 58/23 D |
| 3,889,460 | 6/1975 | Yasukawa et al. | 58/23 R |
| 3,914,932 | 10/1975 | Teraishi et al. | 58/23 R X |
| 3,955,352 | 5/1976 | Berney | 58/23 R |
| 3,973,099 | 8/1976 | Morris, Sr. | 58/85.5 X |

*Primary Examiner*—Stanley J. Witkowski
*Attorney, Agent, or Firm*—Frank J. Jordan

[57] ABSTRACT

An electronic timepiece in which a higher frequency signal from a frequency standard is divided down to a lower frequency drive signal by a frequency converter. The drive signal is applied through a driver circuit to an electro-mechanical transducer which actuates time-representing members to indicate time. A control means is coupled to intermediate stages of the frequency converter and produces higher frequency drive signals. At least one contact plate made of flexible, electrically conductive material is adapted to be depressed from outside the watch case through a recess formed therein whereby the control means is connected to the driver circuit to apply the higher frequency drive signals to the electro-mechanical transducer thereby rapidly advancing the time-representing members.

9 Claims, 23 Drawing Figures

Fig. 2A
Fig. 2
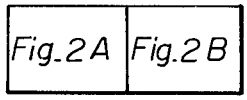
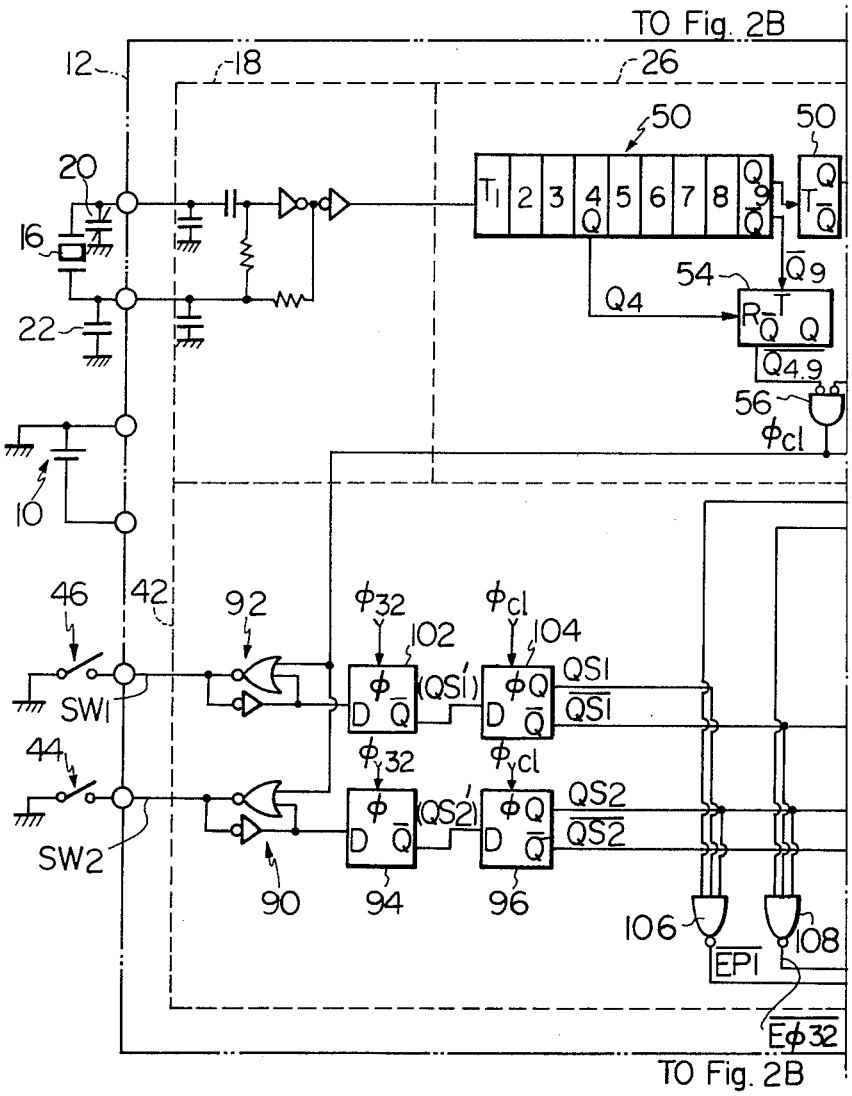

ELECTRONIC TIMEPIECE

This invention relates to battery powered timepieces and, more particularly, to an electronic timepiece of the type including a time dial.

Battery powered wristwatches and other small portable timekeeping device of various types are well known and are commercially available. These wristwatches usually have a manual time setting mechanism including a crown, stem, clutch wheel, setting wheel, setting lever etc. to perform various functions such as time setting or advancing hours, minutes and seconds. Due to inherent arrangement of these components, the watch is necessarily complicated in construction, and it is difficult to provide ease of assembly and ease of maintenance. A resulting watch is more expensive to manufacture, and evidences decreased shock and impact resistance. Another drawback encountered is that the wristwatch can not be manufactured in small thickness.

It is, therefore, an object of the present invention to provide an improved electronic timepiece which is simple in construction and easy to manufacture.

It is another object of the present invention to provide an improved electronic timepiece in which a conventional crown and stem are dispensed with.

It is another object of the present invention to provide an improved electronic timepiece which provides ease of assembling and low manufacturing costs.

It is still another object of the present invention to provide an improved electronic timepiece which can be manufactured in small size and has a small thickness.

These and other objects, features and advantages of the present invention will become more apparent from the following description when taken in conjunction with the accompanying drawings, in which:

FIGS. 2, 2A and 2B show a preferred example of a detail electric circuitry for the electronic timepiece shown in FIG. 1;

Figure 1:
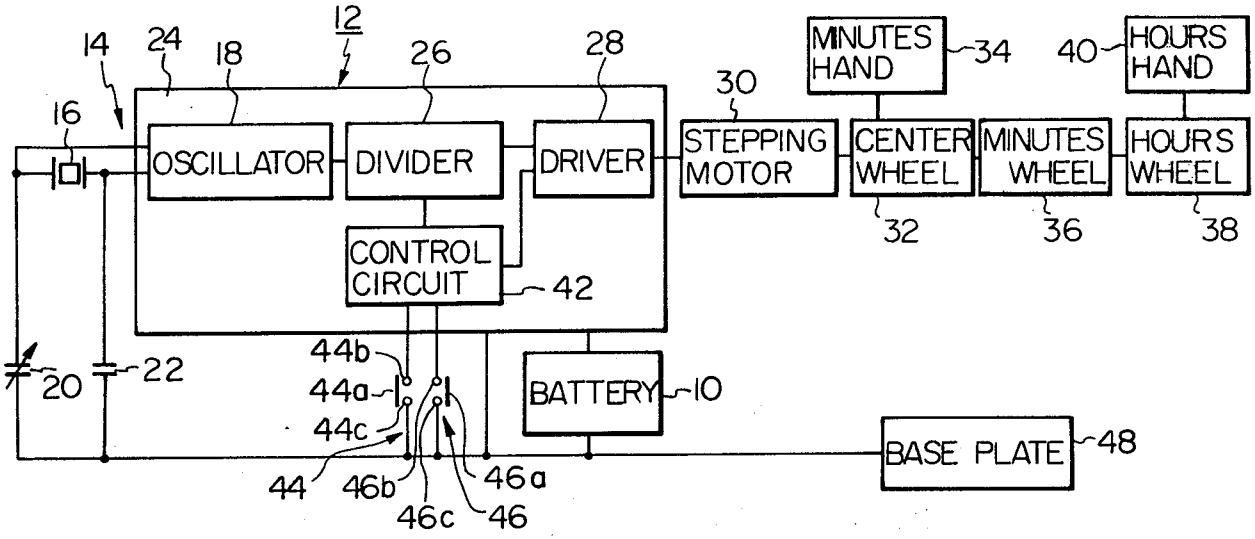
FIG. 1 is a block diagram of an electric circuitry for an electronic timepiece according to the present invention.

Referring now to FIG. 1, there is shown a simplified block diagram of an electric circuitry for an electronic timepiece according to the present invention. As shown, the electronic timepiece comprises a souce of electric power such as a battery 10, and an electronic timekeeping means 12 connected thereto. One terminal of the battery 10 is connected to the base plate 48. The electronic timekeeping means 12 is comprised of a frequency standard 14 including a quartz crystal 16 and an oscillator circuit 18 connected thereto to provide a relatively high frequency signal. A first terminal of the quartz crystal 16 is connected to the base plate 48 through a variable trimming capacitor 20 for fine adjustment of the oscillator frequency. A fixed trimming capacitor 22 is connected between a second terminal of the quartz crystal 16 and the base plate 48. The oscillator circuit 18 is incorporated on a large-scale integrated circuit chip 24. The timekeeping means 12 also comprises a frequency converter in the form of a divider 26, which is incorporated on the circuit chip 24 and is connected to the oscillator circuit 18. The frequency divider 26 divide down the relatively high frequency signal to provide a first low frequency signal, a second low frequency signal lower in frequency than the first low frequency signal, and a third low frequency signal lower in frequency than the second low frequency signal. The third low frequency signal is applied to a driver circuit 28 by which normal driving current pulses are produced and applied to a stepping motor 30; Stepping motor 30 has a rotor (not shown) connected to a center wheel 32 by which a minutes hand 34 is rotated. The center wheel 32 is in turn connected through a minutes wheel 36 to an hours wheel 38 by which an hours hand 40 is rotated. The timekeeping means 12 further comprises a control circuit 42 incorporated on the circuit chip 24 and arranged to selectively pass the first and second low frequency signals to the driver 28 which produces driving current pulses a high frequencies to rapidly advance the minutes or hours hand when so required. To this end, the control circuit 42 is connected to first and second manually operble switches 44 and 46 which permit hours setting and minutes setting, respectively. The first switch 44 is comprised of a movable contact plate **44*a*, and a pair of stationary contacts 44*b* and 44*c* connected to the control means 42 and base plate 48, respectively. Likewise, the second switch 46 is comprised of a movable contact plate 46*a*, and a pair of stationary contacts 46*b* and 46*c* connected to the control means 42 and the base plate 48, respectively. The base plate 48 supports the quartz crystal 16, the trimming capacitors 20 and 22, the circuit chip 24** and the mechanical parts of the watch.

In operation, the oscillator circuit 18 produces a high frequency of 32,768 Hz, which is applied to the frequency divider 26. The divider 26 divides the output frequency of the oscillator circuit 18 to provide an output signal of one pulse per minute. A drive signal of this frequency is applied to the stepping motor 30, whereby the rotor of the stepping motor 30 is periodically rotated. This rotation is transmitted to the center wheel 32 which consequently rotates the minutes hand 34 in stepwise manner. The rotation of the center wheel 32 is transmitted through the minutes wheel 36 to the hours wheel 38 by which the hours hand 40 is rotated.

Figure 2B:
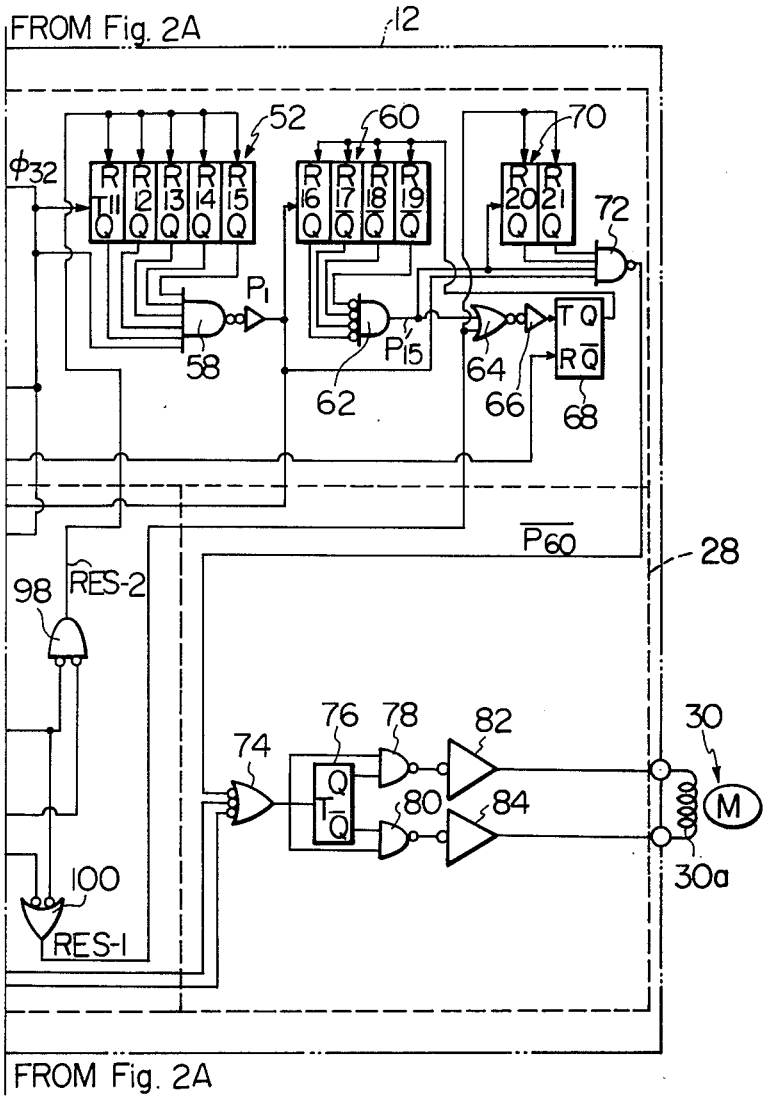
Figure 3:
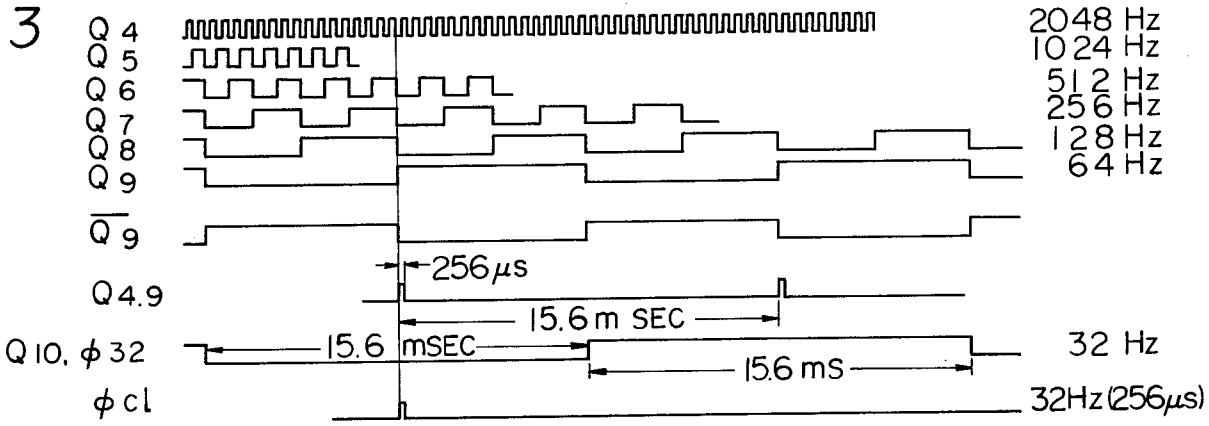
FIGS. 3 through 6 show waveforms at various locations in the circuit of FIG. 2.

During time setting, when contact plate **44*a* of the first setting switch 44 is depressed, the stationary contact 44b leading to the control circuit 42 is thereby connected to the stationary contact 44c leading to the base plate 48. At this instant, the control circuit 42 is activated and passes the first low frequency signal of 32 Hz to the driver circuit 28. The driver circuit 28 then generates driving current pulses at 32 Hz by which the stepping motor 30 is rotated at a higher speed thereby advancing the hours by one hour within about two seconds. When, further, the second setting switch 46 is actuated while the first setting switch 44 actuated, the control circuit 42 passes the second low frequency signal of 1 Hz to the driver circuit 28. In this case, the driver circuit 28 produces driving current pulses at 1 Hz to drive the stepping motor 30, so that the minutes are advanced by one minute within one second. In this manner, the hours and minutes hands can be readily advanced to the desired settings. When the desired settings are attained, the contact plate 44a of the first setting switch 44 is released, causing the frequency divider 26 to be reset and the hours and minutes hands 38 and 40 to remain in their set positions. In order to start the operation of the watch, the contact plate 46a of the second setting switch 46 is released. Driving pulses are thereby produced by the driver 28, which energizes the stepping motor 30 precisely one minute after release of the contact plate 46a. The watch will thereafter operate in the normal mode. A preferred example of detailed circuitry for the electronic timepiece is shown in FIGS. 2, 2A and 2B, in which like or corresponding component parts are designated by the same reference numerals as those used in FIG. 1. As previously described, one terminal of the quartz crystal 16 is connected to the oscillator 18 which produces an output signal at a frequency of, for example, 32,768 Hz. This signal is applied to the frequency divider 26 which provides various low frequency signals. The frequency divider 26 includes ten stages of series-connected flip-flops 50. The input to the first of these stages is the output of the oscillator 18, and the input to the second stage is the output of the first stage. The remaining stages are similarly connected, and the output of the tenth stage provides a first low frequency signal $\phi_{32}$ of 32 Hz to stage 11 of flip-flops 52. Outputs $Q_4$ and $\overline{Q_9}$ of 50 are input to flip-flop 54, which provides input $\overline{Q_{49}}$ to NOR gate 56, to which the first low frequency signal $\phi_{32}$ is also applied. Thus, the NOR gate 56 provides an output $\phi_{cl}$ of 32 Hz. A timing diagram for each flip-flop stage is shown in FIG. 3**.

Figure 4:
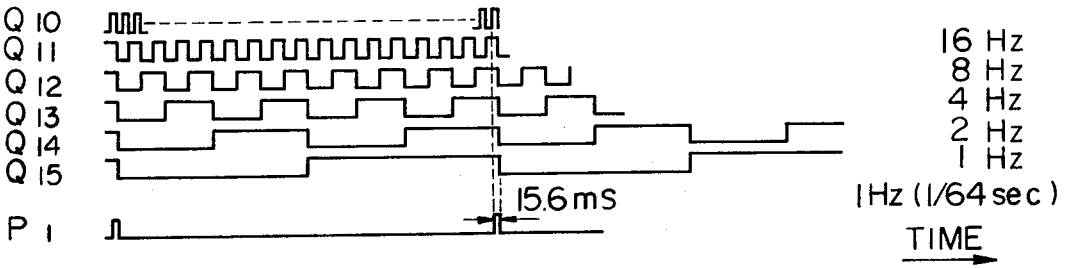
Figure 5:
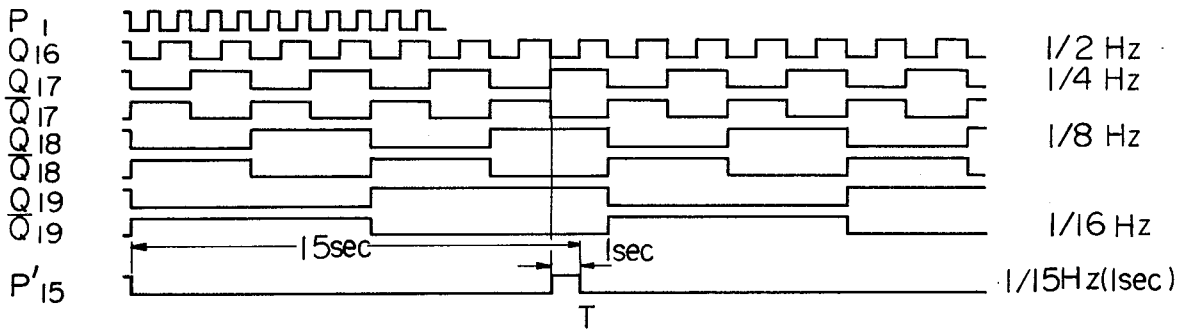
Figure 6:
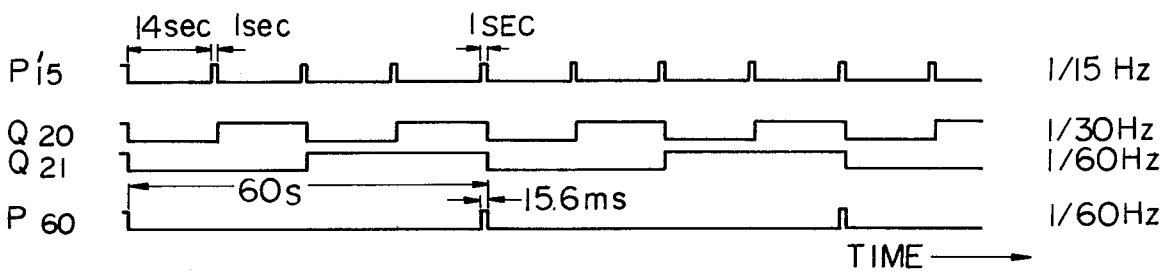

Pulses $\phi_{32}$ and the outputs of stage 11 and stage 15 of 52 are applied to NAND gate 58, which provides a second low frequency signal $P_1$ at a low frequency of 1 Hz and a pulse duration of 15.6 milliseconds as shown in the timing diagram of FIG. 4. The output $P_1$ is applied to stage 16 of flip-flops 60. The outputs of stages 16 to 19 of 60 are applied to NOR gate 62 which provides an output $P'_{15}$ at a frequency of 1/15 Hz, as shown in the timing diagram of FIG. 5. The output $P'_{15}$ has a pulse duration of 1 second and is input through NOR gate 64 and inverting amplifier 66 to a flip-flop 68, the output of which is applied to the reset terminals of the flip-flops 60. The output $P'_{15}$ is also input to stage 20 of flip-flops 70. The output $P'_{15}$ and the outputs of the flip-flops 70 are applied to NAND gate 72 which provides a third low frequency signal as an output $\overline{P_{60}}$ at a frequency of 1/60 Hz and pulse duration of 15.6 milliseconds as shown in FIG. 6.

The output $\overline{P_{60}}$ is applied to NAND gate 74 of the driver circuit 28 the output of which is applied to flip-flop 76 and NAND gates 78 and 80, which produce alternating drive pulses at a frequency of 1/120 Hz, with a period of 60 seconds between pulses of opposite polarity. These driving pulses are applied thrugh inverting amplifiers 82 and 84 to a driving coil 30a of the stepping motor 30 to energize the same. Thus, the rotor of the stepping motor 30 is rotated stepwise once every 60 seconds, so that minutes and hours hands are driven in a manner as previously mentioned.

Figure 7:
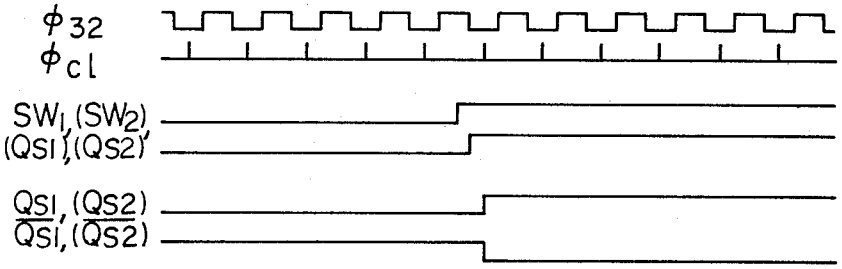
FIGS. 7 through 10 show similar waveforms for the circuit of FIG. 2 when switch means are operated in various modes.

The control circuit comprises first and second logic level setting circuits 90 and 92 connected to the external switches 44 and 46, respectively. Each of the logical level setting circuits includes an inverting amplifier and a NOR gate connected in a positive feedback loop. The input of inverter is connected to the output of the NOR gate and also to a switch terminal, while one input of the NOR gate is connected to the output of the inverter and the other to the output of NOR gate 56. It is apparent that if a logic high "H" signal is applied momentarily to the NOR gate input, its output will remain latched in the low "L" state. If, however, a continuing "H" level is applied to the NOR gate output by closing the switch connected thereto, the output of the NOR gate will remain in the "H" and the inverter output in the "L" state. Thus, while the switches 44 and 46 are left opened, the outputs of logic level setting circuits 90 and 92 will remain latched in the "H" state. The output of logic level setting circuit 90 is connected to a first stage flip-flop 94 which provides an output (QS2'). This output is applied to a second stage flip-flop 96 which provides an output $QS_2$ which is applied through a NOR gate 98 to the reset terminals of stages 11 to 15 of the flip-flops 52, thereby resetting flip-flops 52. The output $\overline{QS_2}$ is applied through a NAND gate 100 to the reset terminals of stages 20 and 21 of flip-flops 70 to reset the same. Likewise, the output of logic level setting circuit 92 is applied to a first stage flip-flop 102 which provides an output (QS1'). This output is applied to a second stage flip-flop 104 which provides outputs $QS_1$ and $\overline{QS_1}$. The output $QS_1$ is applied to a NAND gate 106 to which outputs $P_1$ and $QS_2$ are also applied. The output $\overline{QS_1}$ is applied to a NAND gate 108, to which outputs $\phi_{32}$ and $QS_2$ are also applied. The relationship between the operating modes of switches 44 and 46 and the outputs of second stages 96 and 104 is shown in FIG. 7.

Figure 8:
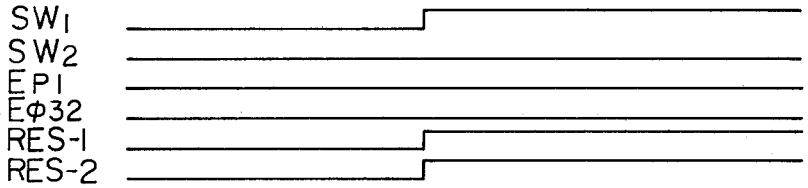

In operation, if the switch $SW_1$, (i.e. the switch 46) is closed in a manner shown in FIG. 8 with the switch $SW_2$ kept open, the output $QS_1$ of second stage 104 becomes high and output $\overline{QS_1}$ becomes low while the output $QS_2$ of second stage 96 remains in the "L" state and the output $\overline{QS_2}$ remains in the "H" state so that the flip-flops 52 and 70 are reset to zero. Consequently, the outputs RES-1 and RES-2 of gates 100 and 98 become high. Under this condition, the NAND gates 106 and 108 are inhibited so that the outputs $\overline{EP_1}$ and $\overline{E\phi_{32}}$ are held in the "H" state. Consequently, no input is applied to the NAND gate 74 and, therefore, the movement of the timepiece is stopped.

Figure 9:
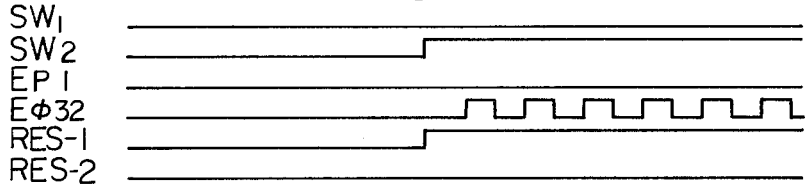

If, next, the switch $SW_2$ is closed while the switch $SW_1$ is kept open, in a manner shown in FIG. 9, the output $QS_2$ of second stage 96 becomes high and the output $\overline{QS_2}$ becomes low while the output $QS_1$ of second stage 104 remains in the "L" state and the output $\overline{QS_1}$ remains in the "H" state. Under this condition, the output of NAND gate 108 goes to the "L" level when $\phi_{32}$ goes to "H" level, and the output $\overline{E\phi_{32}}$ is applied to the NAND gate 74. At the same time, the output $\overline{QS_2}$ of the flip-flop 96 is applied to the NOR gate 100 so that the flip-flops 70 are reset to zero. Thus, an input signal at a frequency of 32 Hz is applied to the NAND gate 74 and, therefore, the stepping motor 30 is driven at a higher speed, thereby advancing the hours rapidly.

Figure 10:
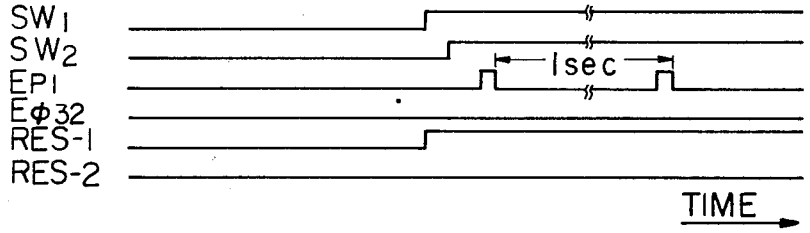

If, further, both of the switches $SW_1$ and $SW_2$ are closed in a manner as shown in FIG. 10, the outputs $QS_1$ and $QS_2$ of the flip-flops 104 and 96 become high and the output $\overline{QS_1}$ and $\overline{QS_2}$ become low. Under these conditions, the output of NAND gate 106 goes to "L" level while the flip-flops 70 are reset to zero in response to a reset signal RES-1 produced by the NAND gate 100. Thus, an input signal at 1 Hz frequency is applied to the NAND gate 74 as shown in the timing diagram of FIG. 10. The stepping motor 30 is thereby driven at a higher speed, whereby the minutes are rapidly advanced. The operating modes of the switches $SW_1$ and $SW_2$ are summarized in the following Table:

Table

| $SW_1$ | $SW_2$ | Driving Freq. | Flip-Flops to be reset |
|---|---|---|---|
| x | x | 1/60 Hz (Normal) | — |
| x | 0 | 32 Hz (Advn.) | 70 |
| 0 | 0 | 1 Hz (Advn.) | 70 |
| 0 | x | — | 52, 70 |

In the above Table, a symbol "*x*" denotes that a switch is open and symbol "0" indicates that the switch is closed.

While the present invention has been shown and described with reference to a particular embodiment, it should be noted that the circuit arrangement may be modified such that when the switch $SW_2$ is closed the stepping motor 30 is driven in response to a driving signal at a frequency of 1 Hz and when the switches $SW_1$ and $SW_2$ are closed the stepping motor 30 is driven in response to the driving signal at a frequency of 32 Hz. It should also be borne in mind that a single switch may be operated in various modes, for example, in consecutive steps, to perform various functions. Alternately, the number of switches may be increased to perform desired functions.

Figure 11:
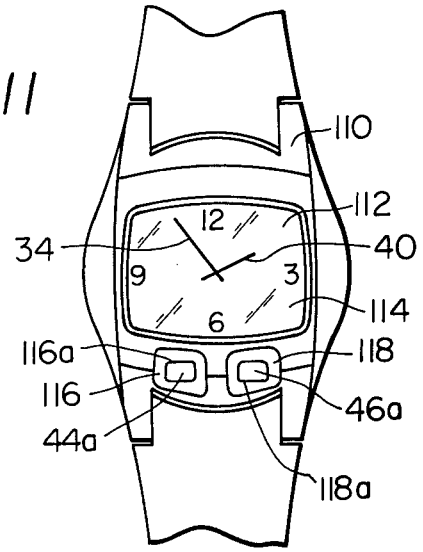
FIG. 11 is a schematic plan view of a watch case forming part of the electronic timepiece shown in FIG. 1.

FIG. 11 shows a wristwatch construted in accordance with the present invention, the watch comprising a watch case 110 having a viewing window 112 and a dial 114. The watch case may be of non-magnetic metal, resin or ceramic materials. The window is preferably formed by a suitable transparent material such as a glass or plastic. A pair of switching windows 116 and 118 and recesses **116*a* and 118*a* are formed in the watch case 110 adjacent the contact plates 44*a* and 46*a*. As shown, the watch case is further formed with curved recesses 116*a* and 118*a* contiguous with the switching windows 116 and 118, respectively, so that the contact plates 44*a* and 46*a*** are readily pressed from outside by the finger of the wearer.

Figure 12:
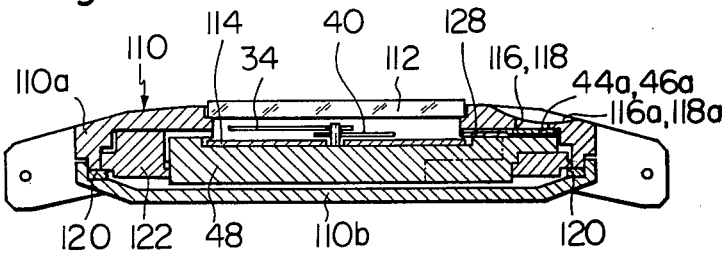
FIG. 12 is a cross sectional view showing internal parts of the watch case shown in FIG. 11.

FIG. 12 is a cross sectional view showing the components of the watch case 110. These comprises a front plate **110*a*, a back cover 110*b* secured to the front plate 110*a*, and a sealing ring 120 mounted between the front plate 110*a* and the back cover 110*b* to provide waterproofing. The base plate 48 is fixedly supported in the watch case 110 by means of a support frame 122** and carries thereon the watch components as already described hereinabove.

Figure 13:
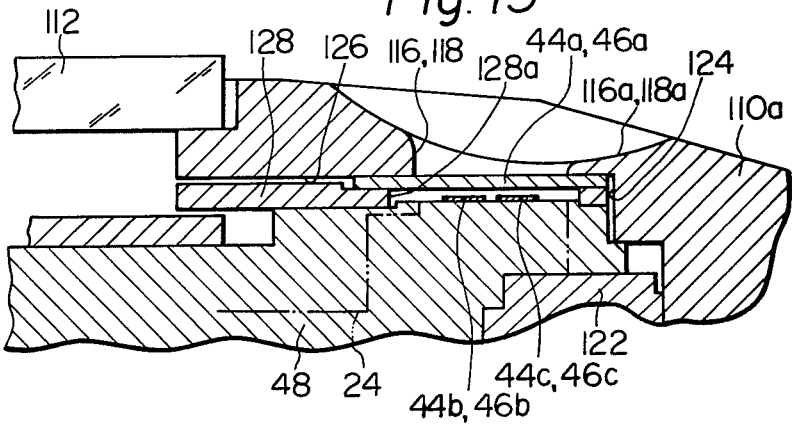
FIG. 13 is an enlarged fragmentary sectional view showing the relationship between the switch means and switch opening or recesses formed in the watch case.

As best shown in FIG. 13, the front plate **110*a* is internally stepped, as at 124, to receive the contact plates 44*a* and 46*a* adjacent the recesses 116*a* and 118*a*. The contact plates 44*a* and 46*a* are pressed at their peripheries against the bottom surface 126 of the front plate 110*a* by a pressure ring 128 disposed between the front plate 110*a* and the base plate 48 so as to prevent the entry of dusts or water into the watch case 110 through the switching windows 116 and 118. The pressure ring 128 has openings 128*a* (only one of which is shown in FIG. 13) to allow deflection of the contact plates 44*a* and 46*a* toward the stationary contacts 44*b* and 44*c* or the stationary contacts 46*b* and 46*c* mounted on the upper wall of the base plate 48**.

Figure 14:
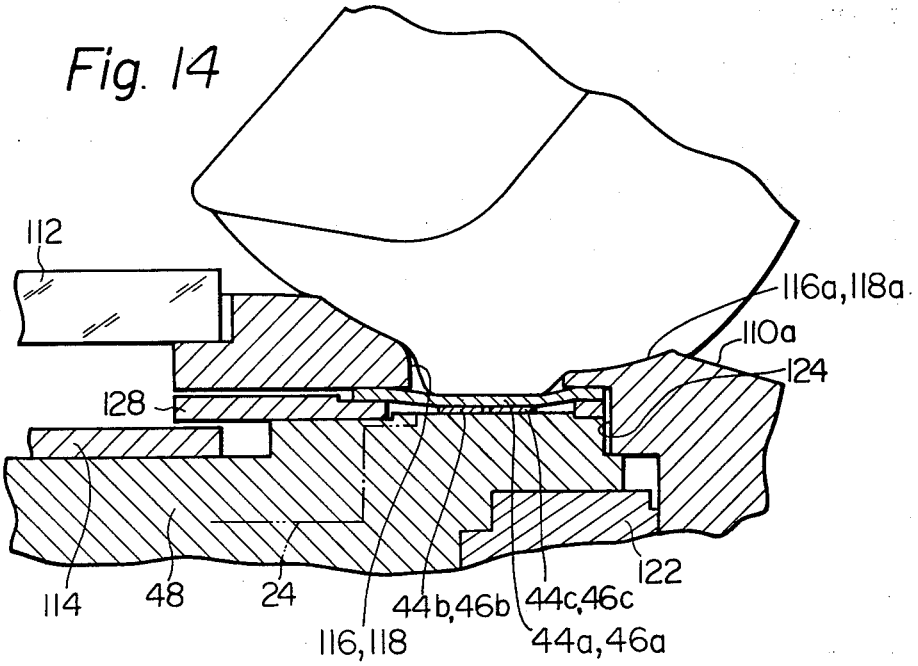
FIG. 14 is a view similar to FIG. 13 but shows a mode of operation of the switch means.

In a normal condition in which the switch plates are not pressed, the switch plates are maintained out of contact with the corresponding stationary contacts as shown in FIG. 13. When, however, it is desired to achieve time setting or other functions, the wearer's finger is placed over the recess **116*a* or 118*a* and presses the contact plate 44*a* or 46*a* toward the stationary contacts 44*b* and 44*c* or the stationary contacts 46*b* and 46*c* as shown in FIG. 14**. In this manner, the stationary contacts are interconnected with each other and desired functions may be performed. It is to be noted that various changes may be desired in the mounting method for the switch plates, distance between the stationary contacts or the insulating method for the switch plates in dependence on the materials forming the switch plates with a view to providing increased water-proof. In a case in which the contact plates are made of electrically conductive metallic material, it is highly desirable to consider about the supporting method for the switch plates so as to sufficiently prevent the entry of dusts or water into the watch case since the contact plates are caused to deflect during operation of the switches.

In a practical embodiment, the switch plates may be made of electrically conductive rubber or resin which are readily commercially available. In a case in which the electrically conductive rubber is utilized, the switching operation may be performed by utilizing inherent elastisity of the rubber and, thus, the contact plates may be supported in a manner easier than the contact plates made of metal. In this instance, however, it is preferred that the contact plates and the stationary contacts be assembled so as not to be accidentally brought into contact with each other when subjected to impacts or vibrations.

Figure 15A:
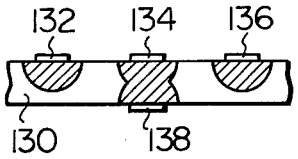
FIGS. 15A and 15B are fragmentary cross sectional views illustrating an example of the switch means made of electrically conductive rubber or resin.
Figure 15B:
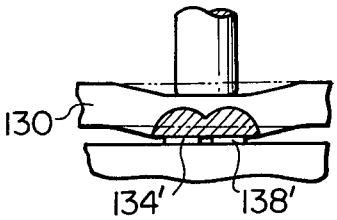

In another embodiment, the contact plates may comprise a sheet of electrically conductive rubber of the type which is partially conductive. Conducting states of the sheet is shown in FIGS. 15A and 15B. As shown, if the sheet 130 is provided with electrodes 132, 134, 136 and 138, the sheet has conductive area adjacent the electrodes viz., at locations indicated in hatched areas. Thus, the electrodes 134 and 138 are interconnected with each other. In a practical embodiment, the sheet 130 has a pair of electrodes 134' and 138' which are spaced by a given distance on the same plane so that the electrodes 134' and 13840 are electrically conducted with each other in a manner as shown in FIG. 15B.

Figure 16A:
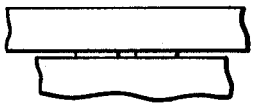
FIGS. 16A and 16B are similar to FIGS. 15a and 15b but show another example of the switch means which can be partially conductive under pressure.
Figure 16B:
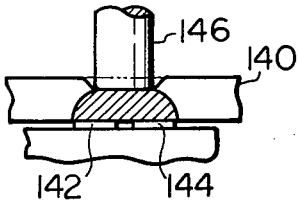

FIGS. 16A and 16B show another embodiment in which a sheet 80 is made of electrically conductive rubber of the type which is electrically conductive only when it is pressed. In FIG. 16A, electrodes 142 and 144 are placed on the same surface of the sheet 140 and spaced apart from each other by a given distance. Whe the sheet 140 is not depressed as shown in FIG. 16A. The electrodes 142 and 144 are not electrically conducted with each other.

Alternately, the contact plate may comprise a flexible insulating sheet made of rubber or resin and coated with conducting metal by evaporation, though not shown.

Figure 17:
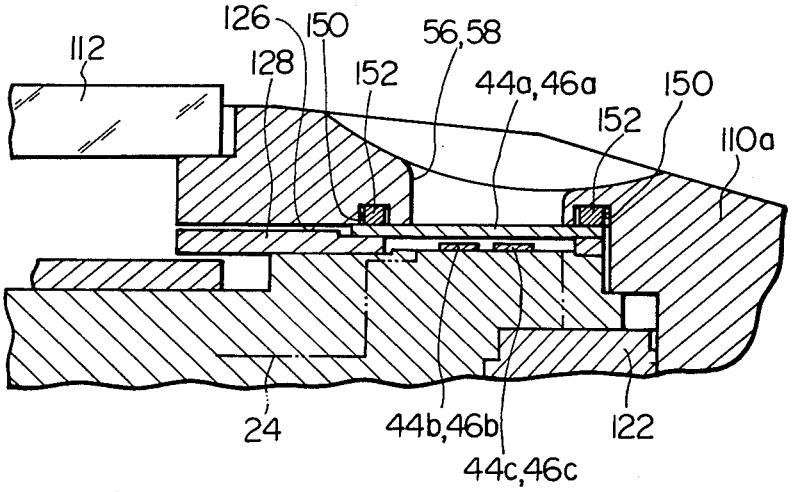
FIG. 17 is an enlarged cross sectional view of a modified form of the watch case.

A modified form of the watch case is illustrated in FIG. 17 in which like or corresponding component parts are designated by the same reference numerals as those used in FIG. 13. In this illustrated modification, the front plate 110*a* is formed on its bottom wall 126 with an annular recess 150 to accommodate a sealing gasket 152 which is disposed between the front plate 110and the contact plate 44*a* or 46*a*. This construction will provide ease of assembly for the sealing, greater reliability and a virtually unlimited life.

Figure 18:
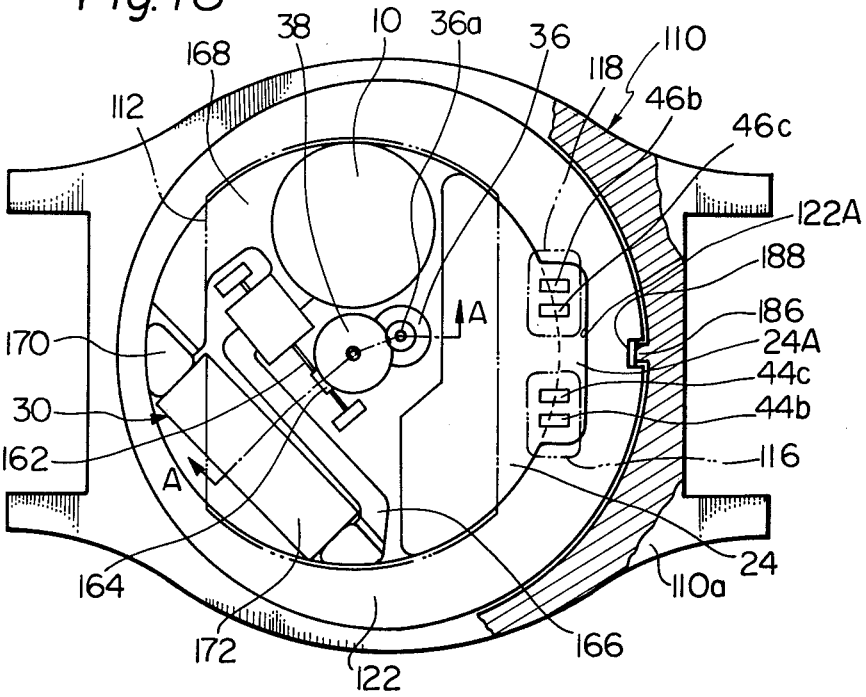
FIG. 18 is a schematic plan view illustrating a detail construction of movements forming part of the electronic time pieceshown in FIG. 1.
Figure 19:
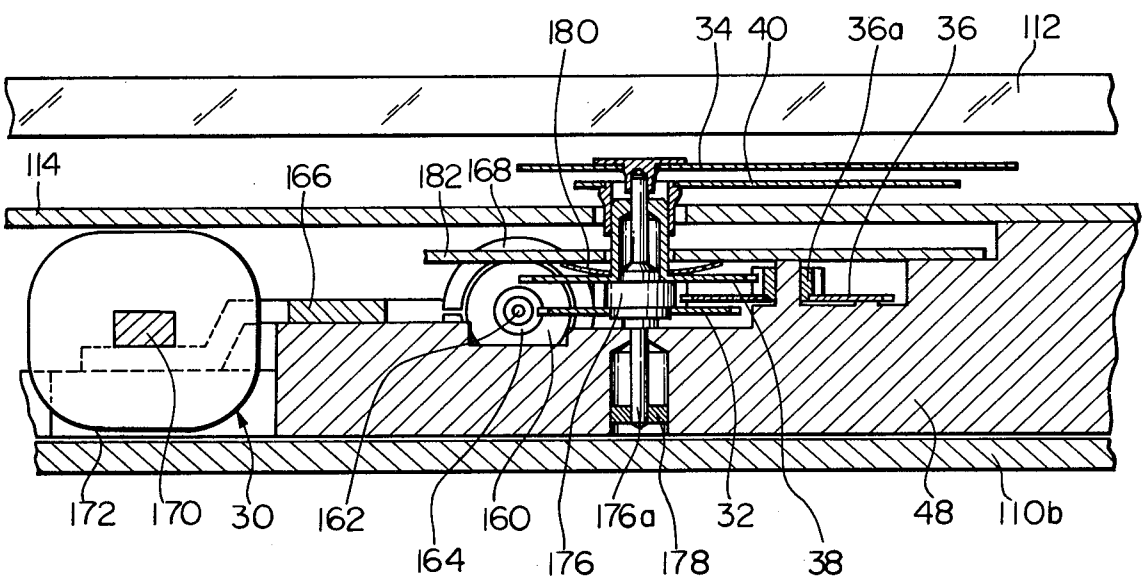
FIG. 19 is an enlarged fragmentary cross sectional view taken on line A—A of FIG. 18.

A detail construction of the movement of the watch is shown in FIGS. 18 and 19 in which like or corresponding component parts are designated by the same reference numerals as those used in FIGS. 11 and 12. As shown, the stepping motor 30 is comprised of a rotor 160 to which a shaft 162 is connected. The shaft 162 carries thereon a worm gear 164 and is disposed in parallel with respect to the dial 114. The stepping motor 30 also includes stators 166 and 168 each including stator pole pieces surrounding the rotor 160. The stators 166 and 168 are connected to each other by means of a core 170 on which a driving coil 172 is wound. As shown in FIG. 19, the worm gear 164 meshes with a center wheel 32 connected to a center wheel pinion 176 having its rotatable shaft 176*a* journalled on the base plate 48 and a bearing 178. An hours wheel 38 is rotatably carried on the center wheel pinion shaft 176*a* and urged downward by a spring 180 disposed between the hours wheel 38 and a plate 182 fixed to the base plate 48. A minutes wheel 36 is rotatably supported on the base plate 48 and meshes with the center wheel pinion 176. The minutes wheel 32 is integrally formed with a minutes wheel pinion 36*a* which meshes with the hours wheel 38. The minutes hand 34 is connected to the rotatable shaft 176*a* while the hours hand 40 is connected to the hours wheel 38. As best shown in FIG. 18, a positioning means is provided between the movement and the support frame 122 so that the movement is easily mounted on the support frame. More specifically, the base plate 24 has a projection 24*a* and the support frame 122 has an indented portion 122*a* with which the projection 24*a* engages. Further, a positioning means is provided between the support frame 122 and the watch case 110 to provide ease of positioning of the support frame with respect to the watch case. More particularly, the front plate 110*a* of the watch case is provided with an inwardly extending projection 186 which engages with a slot 188 formed in the support frame 122. In addition, the central axis of the rotatable shaft 176 lies on a point displaced from the center of the watch case.

In operation, the stepping motor 30 is supplied with a driving pulse in a manner as previously described. Under this condition, the rotor 160 of the stepping motor 30 is rotated 180° per driving pulse. Accordingly, the worm gear 164 causes the center wheel 32 to rotate at one gear tooth per half revolution of the worm gear 164. Since the center wheel 32 has sixty gear teeth, the center teeth 32 will rotate one-sixty revolution per half revolution of the worm gear 164. Therefore, the minutes hand 34 connected to the center wheel 32 is caused to rotate at a degree of one minute. Under this condition, the hours hand 40 is rotated at a speed one-twelve of the minutes hand 34 due to the gear reduction performed by center wheel 32, minutes wheel 36 and hours wheel 38. Time setting is performed by interconnecting the stationary contacts 44*b* and 44*c* or stationary contacts 46*b* and 46*c* with each other by depressing the contact plate from outside through the switch openings 116 or 118 in a manner as already described hereinabove.

With the arrangement mentioned hereinabove, the electronic timepiece of the present invention will provide the following advantages:

1. A hand setting mechanism such as crown, stem, clutch wheel, setting wheel, setting lever etc. can be dispensed with, and a wristwatch embodying the present invention may be manufactured to be small in thickness.

2. Since the associated parts of the hand setting mechanism are dispensed with, fabrication of the base plate for the watch is significantly simplified.

3. Since the stem and the crown are dispensed with, the watch case may be manufactured in the easiest manner.

4. A wristwatch of the present invention may have various designs or configurations which can not be provided in the prior art wristwatches.

To obtain these advantages in a more satisfactory fashion, it is desirable to arrange the wristwatch in the following manner:

1. Rotational axis of the bands is displaced from the central axis of the watch case whereby display portion and switch openings are arranged in a suitable area of the watch case without interfering with each other.

2. Switch openings may be provided on side wall or back cover of the watch case to provide a larger spacing for the time display and improved operability of the switches.

3. Positioning means are provided between the movement and the support frame and between the support frame and the watch case to assemble the movement into the watch case in the simplest manner.

4. The support frame may be dispensed with and positioning means may be provided between the movement and the watch case.

5. A base plate and watch case may be made of resin or ceramic materials whereby the wristwatch is simplified in construction and manufactured to be small in weight. This is particularly advantageous in the wristwatch in which the watch case does not have a conventional transverse bore for the stem.

While the present invention has been shown and described with reference to a particular embodiment in which only minutes and hours hands are provided, it should be noted that the concept of the present invention may also be applied to a wristwatch in which a seconds hand is also provided. It should further be understood that various changes or modifications, may be made to the arrangement of the control switch means without departing from the scope of the present invention.

What is claimed is:

1. An electronic timepiece comprising, in combination: a frequency standard providing a relatively high frequency signal;

a frequency converter dividing down the relatively high frequency signal;

to provide a first low frequency signal, a second low frequency signal lower in frequency than said first low frequency signal, and a third low frequency signal lower in frequency than said second low frequency signal;

first and second manually operable switches;

a control circuit including means for generating first and second outputs when said first and second manually operable switches are actuated, respectively, means for generating a first output signal in reponse to at least said first output and said first low frequency signal, and means for generating a second output signal in response to at least said second output and said second low frequency signal;

a driver circuit normally providing first driving current pulses in response to said third low frequency signal and responsive to said first and second output signals from said control circuit to provide second and third driving current pulses, respectively, at frequencies equal to those of said first and second low frequency signals; and an electro-mechanical transducer normally driven by said first driving current pulses to advance rotatable time-representing members stepwise once per every one unit time and responsive to said second and third driving current pulses to advance said time-representing members at first and second speeds higher than a normal rotational speed in which said electromechanical transducer is driven by said first driving current pulses, whereby time correction can be performed at different speeds.

2. An electronic timepiece according to claim 1, in which said time-representing members comprise a minutes hand connected through a center wheel to said electro-mechanical transducer, and an hours hand connected through hours and minutes wheels to said center wheel.

3. An electronic timepiece according to claim 1, in which said frequency standard, frequency converter, control circuit and driver circuit are incorporated on an integrated circuit chip, and further comprising a watch case, a support frame fixedly mounted in said watch case, and a base plate supported by said support frame in said watch case and carrying thereon said integrated circuit chip, said watch case including a front plate and a back cover secured thereto.

4. An electronic timepiece according to claim 3, in which at least one of said manually operable switches comprises a flexible contact plate disposed between said front plate and said base plate and held in pressured contact at its periphery with a bottom wall of said front plate, and stationary contacts mounted on an upper surface of said base plate and connected to said control circuit, and in which said front plate of said watch case has a switching window through which said flexible contact plate is deflected.

5. An electronic timepice according to claim 4, in which said flexible contact plate is made of electrically conductive rubber.

6. An electronic timepiece according to claim 4, in which said flexible contact plate is made of electrically conductive resin.

7. An electronic timepiece according to claim 4, further comprising sealing means disposed between said flexible contact plate and said front plate.

8. An electronic timepiece according to claim 3, in which the rotational axis of said time-representing members is displaced from the center of said watch case.

9. An electronic timepiece according to claim 3, in which said electro-mechanical transducer has a rotational shaft extending parallel with respect to a dial and connected to said time-representing members.

* * * * *